US009713392B2

(12) United States Patent
Vinje Brustad et al.

(10) Patent No.: US 9,713,392 B2
(45) Date of Patent: Jul. 25, 2017

(54) BOUNCER OR BOUNCING CRADLE AND A FRAME FOR SUCH

(71) Applicant: Stokke AS, Ålesund (NO)

(72) Inventors: Tore Vinje Brustad, Oslo (NO); Andreas Murray, Oslo (NO); Anders August Kittilsen, Ålesund (NO); Jon Andre Teigen, Ålesund (NO)

(73) Assignee: Stokke AS (NO)

( * ) Notice: Subject to any disclaimer, the term of this patent is extended or adjusted under 35 U.S.C. 154(b) by 0 days.

(21) Appl. No.: 14/387,210

(22) PCT Filed: Mar. 22, 2013

(86) PCT No.: PCT/EP2013/056068
§ 371 (c)(1),
(2) Date: Sep. 22, 2014

(87) PCT Pub. No.: WO2013/139960
PCT Pub. Date: Sep. 26, 2013

(65) Prior Publication Data

US 2015/0289678 A1 Oct. 15, 2015

(30) Foreign Application Priority Data

Mar. 22, 2012 (NO) ..... 20120388

(51) Int. Cl.
*A47D 13/10* (2006.01)

(52) U.S. Cl.
CPC ..... *A47D 13/107* (2013.01); *A47D 13/105* (2013.01)

(58) Field of Classification Search
CPC ..... A47D 13/105; A47D 3/0255
(Continued)

(56) References Cited

U.S. PATENT DOCUMENTS 1,458,077 A * 6/1923 Reid ..... A47D 13/107 248/605
2,704,111 A * 3/1955 Wunderlich ..... A47D 13/107 297/274
(Continued)

FOREIGN PATENT DOCUMENTS

CA 2356501 A1 2/2002
CN 100496340 C 6/2009
(Continued)

OTHER PUBLICATIONS

Slawomir Kus, Authorized Officer, European Patent Office "International Search Report" in connection with related PCT Patent App. No. PCT/EP2013/056068, dated Jun. 28, 2013, 3 pages.

*Primary Examiner* — Rodney Mintz
(74) *Attorney, Agent, or Firm* — Kolisch Hartwell, P.C.

(57) ABSTRACT

The invention concerns a bouncer comprising a base frame and a seat frame. In a use position the seat frame is inclined relative to the base frame. The baby bouncer further comprises a support device movably connecting the seat frame to the base frame. The support device is attached to the seat frame at one or ore respective first connection portions, and to the base frame, such that the inclination alternately increases and decreases during operation of the bouncer, and such that when the inclination of the seat frame decreases, the one or more first connection portions are moved forward relative to base frame, and vice versa.

10 Claims, 7 Drawing Sheets

(58) Field of Classification Search
USPC ..... 297/274, 273
See application file for complete search history.

(56) References Cited

U.S. PATENT DOCUMENTS 3,004,793 A * 10/1961 Loomis ..... A47D 1/00 297/274
3,061,261 A 10/1962 Berlin
3,066,906 A 12/1962 Berlin
3,076,628 A 2/1963 Smith et al.
3,656,728 A 4/1972 Griggs
4,081,869 A * 4/1978 Ash ..... A47D 13/107 297/274
4,188,678 A * 2/1980 Rawolle ..... A47D 13/107 297/274
4,226,467 A 10/1980 Boudreau
4,553,786 A * 11/1985 Lockett, III ..... A47D 1/103 297/440.1
5,172,955 A * 12/1992 Freese ..... A47D 13/107 248/608
5,187,826 A * 2/1993 Mariol ..... A47D 13/107 297/295
5,203,611 A * 4/1993 Greenwood ..... A47D 13/107 297/275
5,207,478 A * 5/1993 Freese ..... A47D 13/107 297/16.1
5,269,591 A 12/1993 Miga, Jr. et al.
5,308,143 A * 5/1994 Cheng ..... A47D 13/107 297/292
5,411,315 A * 5/1995 Greenwood ..... A47D 13/107 297/440.11
5,503,458 A * 4/1996 Petrie ..... A47D 1/002 297/16.1
5,507,564 A * 4/1996 Huang ..... A47D 1/002 297/256.13
5,868,459 A * 2/1999 Welsh, Jr. ..... A47D 1/002 297/16.1
6,361,106 B1 3/2002 Huang
6,594,840 B2 * 7/2003 Tomas ..... A47D 13/107 5/101
6,679,779 B2 * 1/2004 Tai ..... A47D 13/102 297/33
6,854,799 B1 2/2005 Asbach et al.
6,877,802 B2 * 4/2005 Christensen ..... A47D 1/02 297/16.1
6,902,230 B2 * 6/2005 Chen ..... A47D 13/107 297/16.1
7,252,333 B2 * 8/2007 Caldwell ..... A47C 3/04 297/239
7,607,734 B2 10/2009 Clapper et al.
7,779,490 B2 * 8/2010 Bergkvist ..... A47D 13/10 297/DIG. 11
7,780,236 B2 * 8/2010 Bergkvist ..... A47D 13/10 297/256.13
8,205,943 B2 * 6/2012 Zhong ..... A47D 13/102 297/258.1
8,322,789 B2 * 12/2012 Mendes ..... A47D 13/107 297/184.13
8,356,862 B2 * 1/2013 Biermann ..... A47C 1/026 297/354.1
D691,381 S * 10/2013 Kittilsen ..... D6/344
8,746,794 B2 * 6/2014 Oren ..... A47D 11/005 297/118
8,845,023 B2 * 9/2014 Chen ..... A47D 13/102 297/258.1
8,845,028 B2 * 9/2014 Miller ..... A47D 1/002 297/118
8,992,283 B2 * 3/2015 Piwko, Jr. ..... A47D 15/00 446/130
2002/0063457 A1 5/2002 Hsia
2003/0020317 A1 1/2003 Keegan et al.
2003/0096654 A1 * 5/2003 Tai ..... A47D 1/02 472/135
2005/0253432 A1 * 11/2005 Flanagan ..... A47D 13/10 297/274
2006/0012230 A1 * 1/2006 Kennedy ..... A47C 3/02 297/261.3
2007/0111809 A1 5/2007 Bellows et al.
2009/0256408 A1 * 10/2009 Bergkvisit ..... A47D 13/10 297/354.12
2011/0031783 A1 * 2/2011 Zhong ..... A47D 13/102 297/32
2011/0089734 A1 * 4/2011 Biermann ..... A47C 1/026 297/313

FOREIGN PATENT DOCUMENTS

CN 201271026 Y 1/2010
CN 202035821 11/2011
CN 202035822 U 11/2011
JP 60021710 S 2/1985
JP 61184452 S 11/1986
JP 06031549 H 4/1994
JP 2001112579 A 4/2001
JP 2007159709 A 6/2007
NL 4360 12/1919
WO 2008004959 A1 1/2008

* cited by examiner

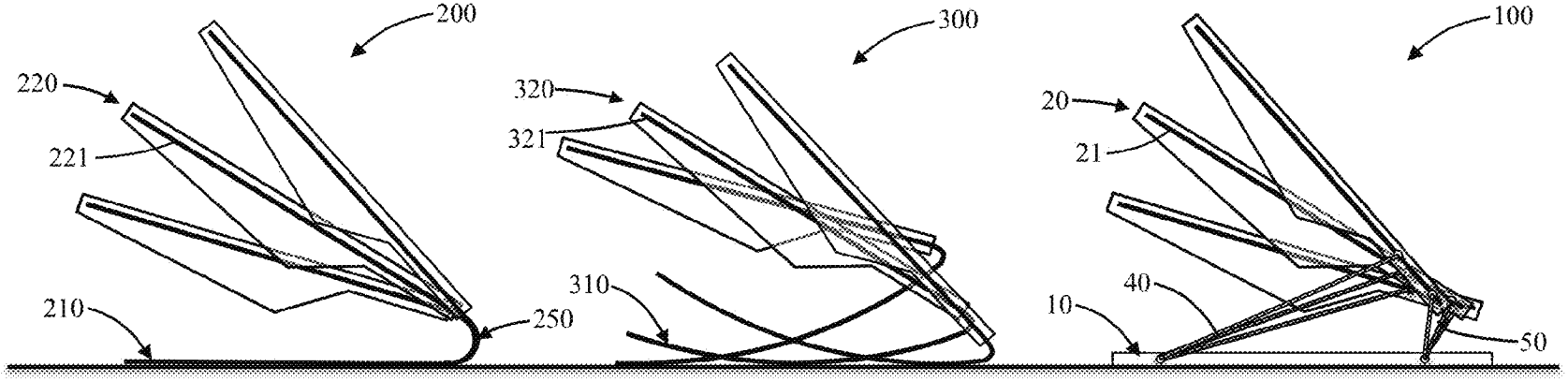
Fig. 4A
Fig. 3A (prior art)
Fig. 2A (prior art)
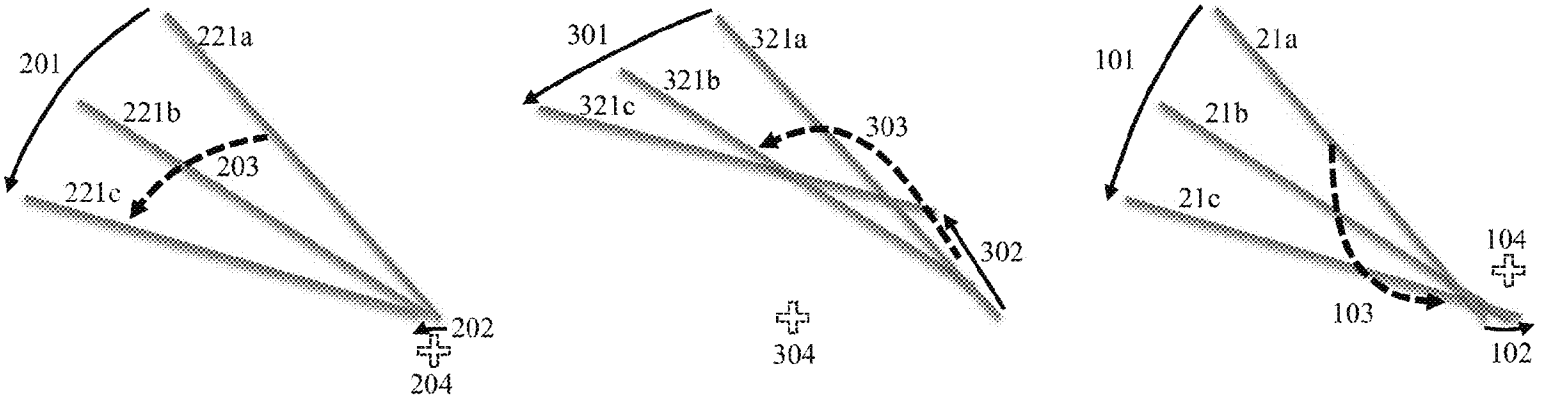
Fig. 4B
Fig. 3B (prior art)
Fig. 2B (prior art)

BOUNCER OR BOUNCING CRADLE AND A FRAME FOR SUCH

The present invention concerns a bouncer or bouncing cradle and a frame for such.

BACKGROUND OF THE INVENTION

Bouncers are used for babies and small children, allowing them sit in a semi upright position to have a better overview without loading the back excessively. In addition, bouncers may be used to let a baby move in an up-and-down or bouncing movement to keep the baby content and happy, to let the baby rock safely, as well as for calming the baby such as for falling to sleep, depending on the degree, intensity and direction of the bouncing movement.

The bouncing movement may be instigated by the baby itself shifting its weight within the bouncer, or by an adult gently rocking or pushing down on the bouncer.

A number of bouncers have been made to let the baby train its legs by half jumping up and down. However, the movement in current bouncers does not seem to keep all babies fond and calm.

PRIOR ART

The bouncer chairs presently on the market are mainly based on two different principles for allowing movement of the baby or small child sitting in the bouncer; namely a rocking-chair movement or a simple tilting movement.

U.S. Pat. No. 6,361,106 and US 2002/063457 describe a frame for a baby rocking chair having a curved base for supporting a seat frame and obtaining a rocking movement.

WO 2008/004959 describes a bouncing cradle with a backrest connected in a single pivot mounting to a base for a pivoting/tilting movement.

So called "baby jumpers" for encouraging babies to use their legs are also known from prior art, such as U.S. Pat. No. 3,076,628 and U.S. Pat. No. 3,066,906 wherein a seat by parallel hinging to a base is maintained in a horizontal position while the seat moves up and down and forward and backward, while the jumper at the same time is collapsible.

OBJECTIVE OF THE INVENTION

An objective of the invention is to provide a bouncer providing a more pleasant movement pattern for the baby, rather than only a tilting or rocking-chair movement of previous bouncers.

Further, an objective of the invention is to provide a bouncer with an angle adjustment of its seat, which is simple, safe and easy to adjust in a continuous manner without collapsing the bouncer. An objective is also to provide a bouncer allowing for such angle adjustment or inclination adjustment by the use of one hand while the baby may be seated in the bouncer. An additional objective is to provide a bouncer, which may be moved and/or lifted while retaining its inclination.

Another objective of the invention is to provide a bouncer wherein a seat portion may be collapsed flat onto a base frame portion for easy storage and transport. An additional objective is to provide a means for keeping the bouncer locked in its collapsed state.

SUMMARY OF THE INVENTION

The invention concerns a bouncer according to the independent claims. Further embodiments are apparent from the dependent claims. These and other objects are achieved with a baby bouncer according to an embodiment of the invention. The bouncer comprises a base frame and a seat frame. In a use position the seat frame is inclined relative to the base frame. The baby bouncer further comprises a support device movably connecting the seat frame to the base frame. The support device is attached to the seat frame at one or more respective first connection portions, and to the base frame, such that the inclination alternately increases and decreases during operation of the bouncer, and such that when the inclination of the seat frame decreases, the one or more first connection portions are moved forward relative to base frame, and vice versa. The combination of rotational movement and forward movement at decrease of the inclination of the bouncer, provides the bouncer with a more natural rocking experience for the child and therefore keeps the child more content.

In the use position, the seat frame is typically inclined relative to the base frame at an inner angle between base frame and seat frame of 15-35 degrees. Such inclination provided for a natural movement of the child.

The support device may comprise at least one distance member connecting at least one of the first connection portions to at least one second connection portion of the base frame. Each one of said at least one distance member extends from the base frame forwards when the baby bouncer is in its use position. The at least one distance member provides an inexpensive and reliable means for providing the intended movement of the bouncer of the invention.

The support device may comprise a biasing means configured to elastically deform in response to changes in the inclination of the baby bouncer. Thus, reversible and repeatable bouncing movement is provided for by said biasing means without need of external power means such as a motor for increasing and decreasing the inclination of the bouncer.

The biasing means may comprise a torsion spring attached at a first end to any one of the at least one distance members and at a second end to any one of the base frame or the seat frame, such that the torsion spring is stressed in response to change of the inclination of the baby bouncer. The torsion spring provides a robust and inexpensive means for elastic deformation to keep the bouncer moving back and forth.

The second end of the torsion spring may be rotatably hinged at the respective base frame or seat frame. The second end of the torsion spring is provided with a lever, and the lever is connected to the respective base frame or seat frame by means of a length-adjustable spacer. The combination of torsion spring, lever and length-adjustable spacer provides a robust and inexpensive means for allowing adjustment of the inclination of the bouncer.

The spacer may comprise a first and a second axially aligned spacer element provided on their outside with inverse threads, said spacer elements being joined by a matching threaded sleeve, such that the length of the spacer may be adjusted by rotation of the sleeve. This provides a means for quick adjustment of the length of the spacer using only one hand.

Further, the spacer may comprise a quick-release mechanism comprising a guide means in which the first spacer element is axially slidable, and a catch arm movable between a locking position in which it locks movement of the spacer element within the guide means, and a release position in which it allows the spacer element to move freely move relative to the guide means. This provides a means for allowing quick folding and unfolding of the bouncer whilst keeping the sleeve untouched, thereby allowing the bouncer to be quickly setup to its preferred inclination after storage.

In an aspect the invention relates to a bouncer comprising a base frame and a seat frame wherein the seat frame is pivotally connected to the base frame by at least one rear and at least one front distance member(s);

the rear distance member(s) connected in a first end to rear base frame pivot mounting(s) and in a second end to rear seat frame pivot mounting(s);

the front distance member(s) connected in a first ends to front base frame pivot mounting(s) and in a second end to front seat frame pivot mounting(s);

wherein, within a vertical longitudinal plane of the bouncer, the distance D1 in between the rear base frame pivot mounting(s) and the rear seat frame pivot mounting(s) is larger than the distance D2 between the front base frame pivot mounting(s) and the front seat frame pivot mounting (s).

In an alternative D1 is: at least twice the length of D2; alternatively at least three times the length of D2; alternatively within the range of 2-4 times the length of D2.

In an alternative the rear distance member(s) are non-parallel with the front distance member(s) in an expanded state of the bouncer; alternatively wherein the angle between the rear distance member(s) and the base frame in addition is less than the angle between the front distance member(s) and the base frame.

In an alternative the distance D3 between the rear and front base frame pivot mountings is larger than the distance D4 between the rear and front seat frame pivot mountings.

In an alternative the angle between the front and rear distance member(s) is limited by a spacer, pivotally connected to at least two of: the rear distance member(s), front distance member(s), base frame and seat frame. The spacer may be length adjustable to regulate the inclination of the seat frame.

In an alternative the spacer is length adjustable as it comprises a longitudinal slot with recesses spaced apart along the length of the slot, open in the rearward direction, wherein a transversal part of the return members may run in said slot to adjust the angle between the rear and front distance member(s), and fit into the recess for locking said angle. In another alternative the spacer is length adjustable as it comprises a front and rear threaded shaft connected by an outer coupling threaded on the inside allowing continuous adjustment of the effective length of said spacer by turning said coupling.

The spacer may additionally be extended in an extent to allow for a collapsing of the seat frame onto the base frame. The spacer may comprise a first spacer element and a second spacer element wherein the second spacer element may slide within an adapted housing of the first spacer element. The first or second spacer element may in the opposite end of their connection to each other in addition be length adjustable according to the above to regulate the inclination of the seat.

The second spacer element may comprises a locking element, such as a recess or hole, into which a locking organ, such as a pin, may enter thereby locking the sliding ability of the second spacer element in relation to the front spacer element, such as for an expanded state of the bouncer. The locking organ may be operated by a lever which upon actuation inserts or removes said locking organ from said locking element.

In an alternative, the spacer is pivotally connected:

in a first end to one of the pivot mountings of the base frame or the seat frame; and in a second end to a member selected from: the rear distance member(s), the front distance member(s), the base frame or the seat frame, at a distance from said members pivot mountings;

wherein the selected member is not connected to the pivot mounting to which the first end of the spacer is connected. The second end of the spacer may be pivotally connected to a return member of an end of the rear or front distance member(s).

In an alternative the bouncer comprises a spring means between at least two members selected from: the rear distance member(s), the front distance member(s), the base frame, the seat frame or the return member. The spring means may comprise:

flexible rear or front distance member(s); and/or torsion rotation between the end of the rear or front distance member(s) and its return member; and/or spring loaded sliding pivot mountings in either the base frame or seat frame.

The invention will be further described by the following example embodiments with reference to the drawings, none of which should be construed as limiting the scope of the invention.

DRAWINGS

FIG. 2A shows a side view of a bouncer according to prior art in three reclined positions superimposed on each other, and FIG. 2B shows a side view of the seat frames only of the three reclined positions in FIG. 2A.

FIG. 3A shows a side view of a bouncer according to prior art in three reclined positions superimposed on each other, and FIG. 3B shows a side view of the seat frames only of the three reclined positions in FIG. 3A.

FIG. 4A shows a side view of a bouncer according to the invention in three reclined positions superimposed on each other, and FIG. 4B shows a side view of the seat frames only of the three reclined positions in FIG. 4A.

Figure 6C:
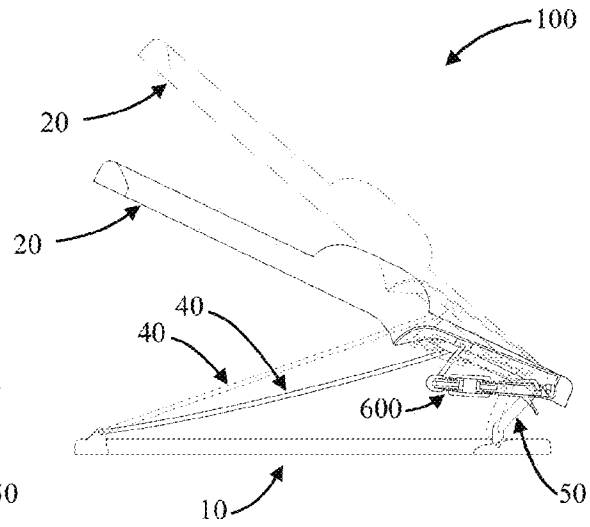
FIG. 6C shows FIGS. 6A and 6B superimposed.
Figure 6B:
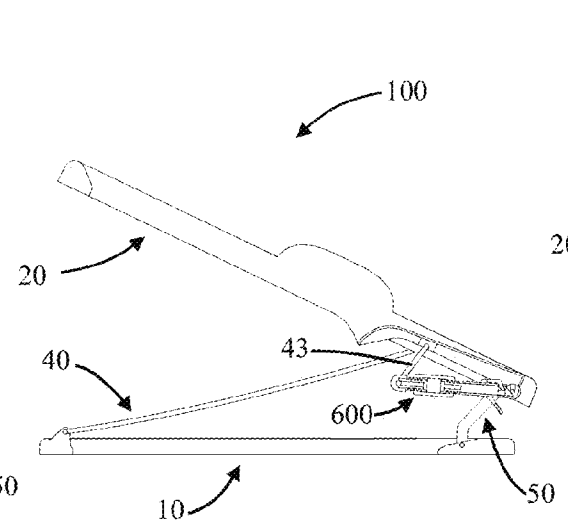
FIGS. 6A and 6B shows a sectional side view of a bouncer according to the invention in two different bouncing position.
Figure 6A:
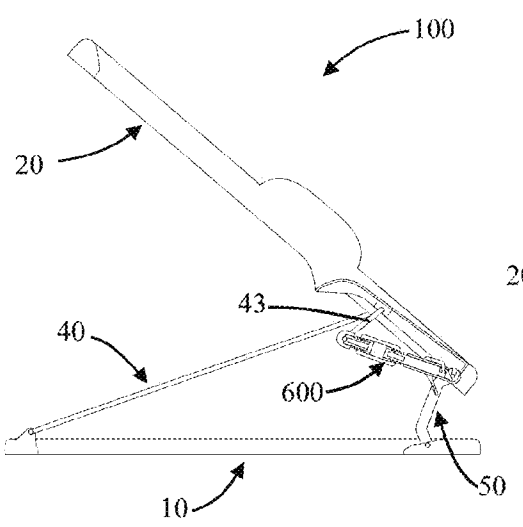
Figure 8B:
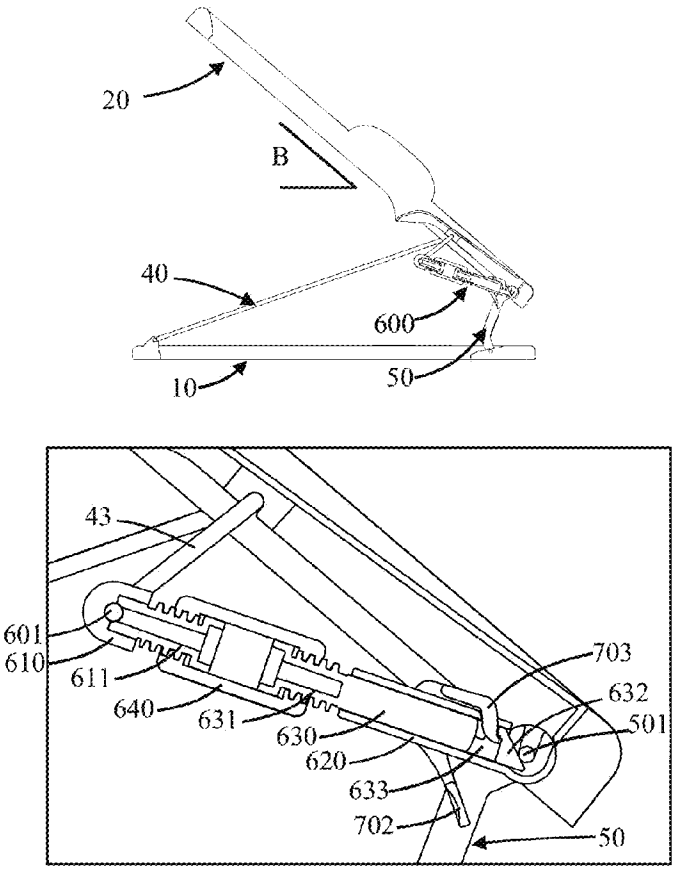
Figure 8A:
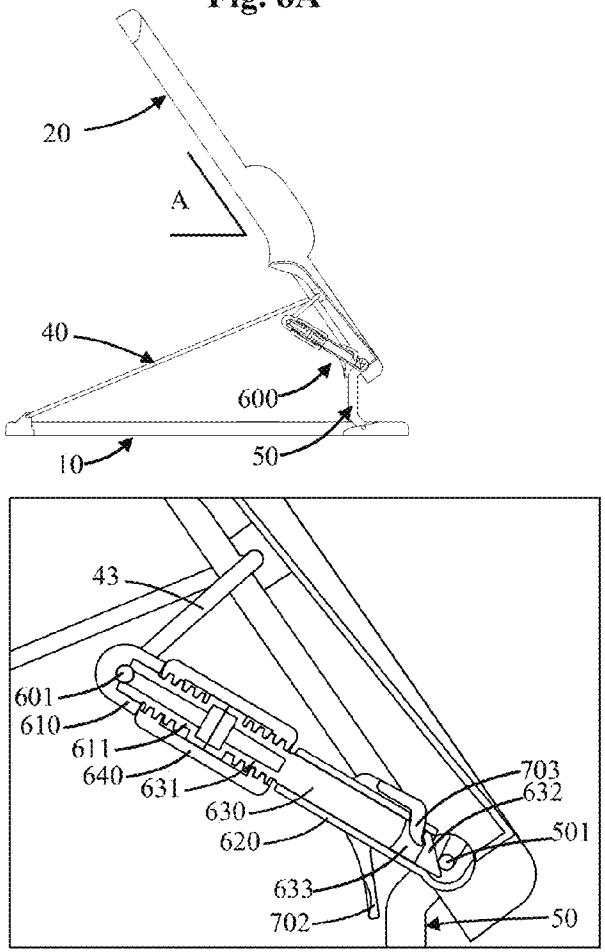

FIG. 8A-B shows sectional side view of the bouncer in FIGS. 6A-C, wherein FIG. 8A shows an erect position and FIG. 8B shows a reclined position with detailed views of seat angle regulating mechanism.

Figure 9C:
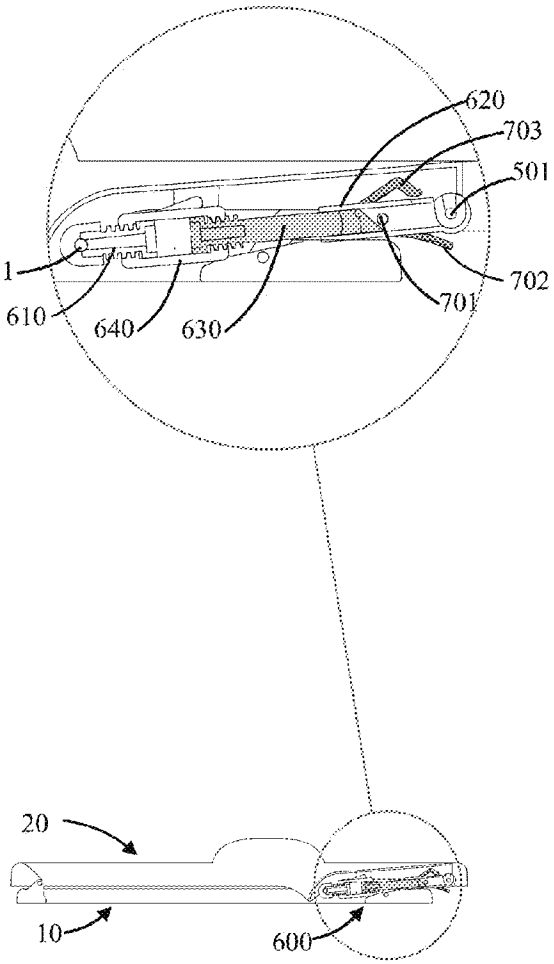
Figure 9B:
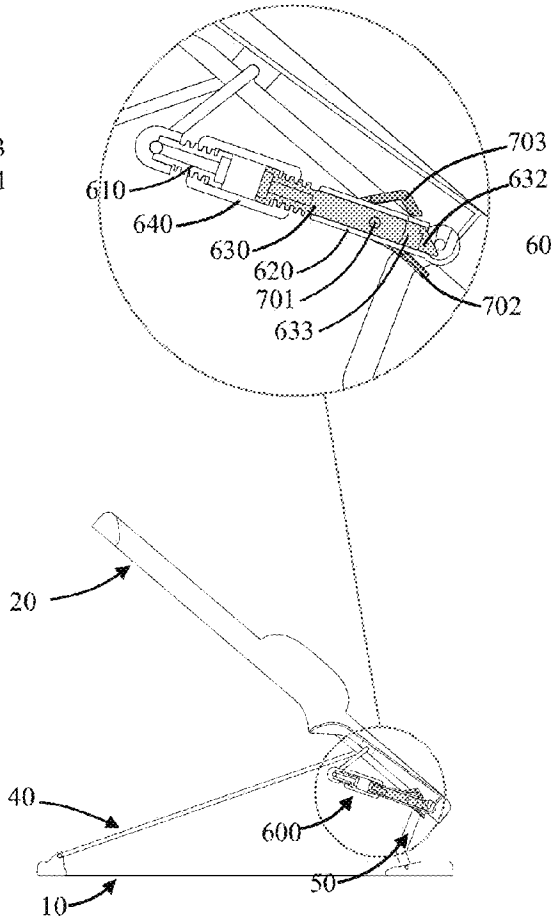
Figure 9A:
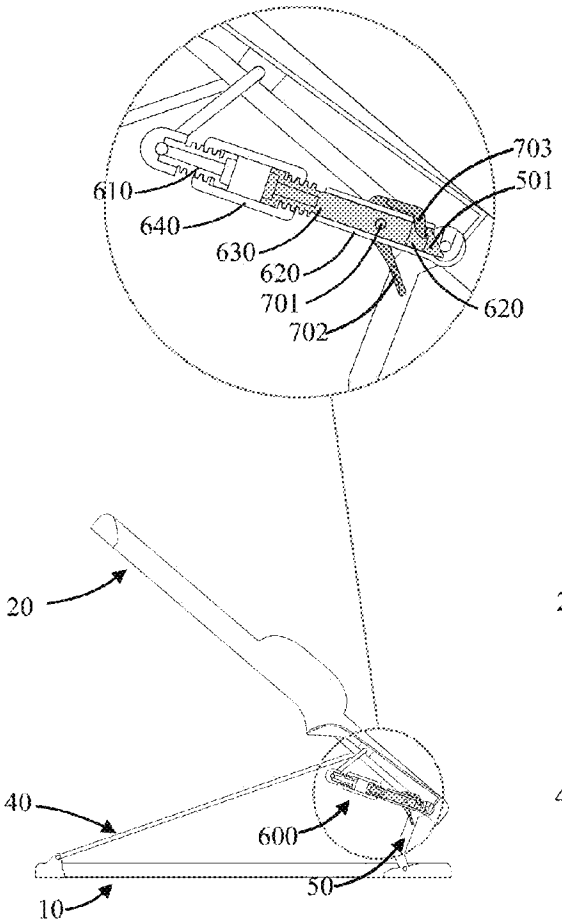

FIGS. 9A-C shows sectional side view of the bouncer in FIGS. 6A-C, including detailed views of a locking mechanism for collapsing the bouncer, wherein FIG. 9A shows the mechanism locked with the bouncer in an expanded state, FIG. 9B shows the mechanism in an un-locked position, and FIG. 9C shows the mechanism unlocked with the bouncer in a collapsed state.

DETAILED DESCRIPTION

In the further description the following terms will be used which should be understood as follows unless otherwise specified.

By the term "in front", "forward", "front" and "forward directed" is meant the mainly horizontal direction, which the face and chest of a baby-sitting in the bouncer is facing during normal use.

Further, by the term "behind", "rearward", "rear" and "rearward directed" is meant the opposite mainly horizontal direction, which is the direction towards which the back of the baby sitting in a bouncer generally is directed towards during normal use of the bouncer.

It should be noted that the terms "rear" and "front" may be used as an indication of the geometric relation of certain parts or objects in relation to each other, and not necessarily to their actual position on the bouncer.

By the term "longitudinal" is meant the mainly horizontal direction within the plane of symmetry of the bouncer and by "lateral" or "transversal" is meant the generally horizontal direction perpendicular on the plane of symmetry of the bouncer. By "inward" is meant the lateral direction towards the plane of symmetry of the bouncer.

The invention will in the following be illustrated by examples of embodiments with referred to the figures, none of which are limiting for the invention.

Figure 1B:
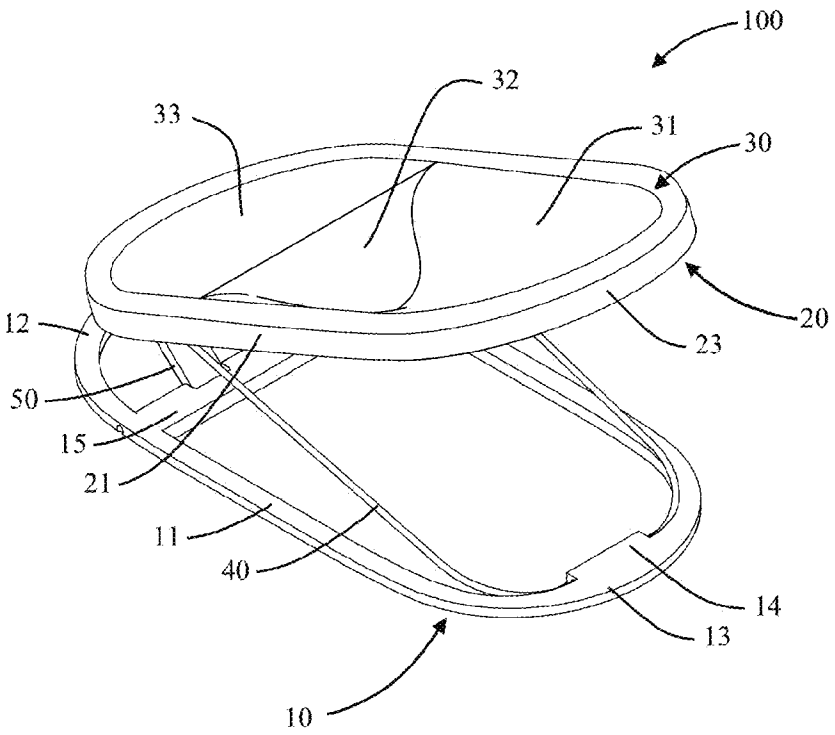
FIG. 1B shows a rear perspective view of the bouncer in FIG. 1A.
Figure 1A:
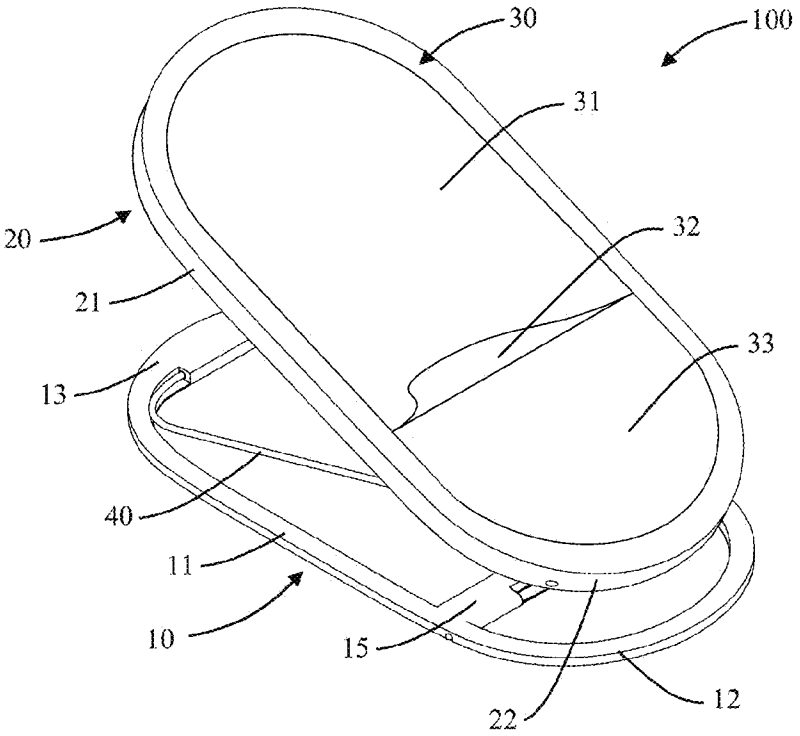
FIG. 1A shows a front perspective view of a bouncer with a frame according to the invention.

FIGS. 1A and 1B illustrate in a front and rear perspective view, respectively, an embodiment of the bouncer 100 according to the present invention in an expanded position. The bouncer 100 comprises a base frame 10 for accommodating the bouncer on a support, such as a floor, and a seat frame 20 with a seat support 30. The seat frame 20 is pivotally connected to the base frame 10 by pairs of rear and front distance members 40 and 50 respectively. Any of the pairs of distance members may alternatively be replaced by single distance members of a suitable shape and width to obtain a similar function.

The base frame 10 comprises in this embodiment two parallel longitudinal side parts 11 connected together in the front by a front transversal frame part 12 and in the rear by a rear transversal frame part 13, both transversal parts having the form of semicircles. In addition, the base frame comprises a transversal part 15 between the longitudinal side parts 11 for accommodating front distance members 50 connecting the base frame 10 to the seat frame 20. The base frame may alternatively comprise several transversal or longitudinal parts for stiffening the frame or provide accommodation for connecting or distance members. Alternatively the base frame 10 may comprise a mainly solid plate, but in order to reduce weight, such as for ease of transport, a more open structure may be used.

The seat frame 20 comprises two parallel longitudinal side parts 21 connected together in the front by a front transversal frame part 22 and in the rear by a rear transversal frame part 23, both transversal parts having the form of semicircles in this embodiment. A seat support 30 is fastened to and spanned over the seat frame 20 and its frame parts. The seat support is divided into three main parts from rear to front, comprising a head and backrest part 31, a seat part 32 and a leg rest 33, providing a comfortable and adapted support for the baby when it lies or sits in the bouncer. The seat support 30 may comprise a flexible material, such as textile, possibly with rigid or semi rigid integrated parts, such as in the seat part 32 to maintain support and shape of said part of the seat support. At the same time, such rigid or semi-rigid parts should be flexibly connected to adjacent parts to allow for the seat frame 20 to collapse onto the base frame and become generally flat.

Hence, in the embodiment of FIGS. 1A and 1B, the seat frame 20 and base frame 10 have the same general shape which enables the seat frame 20 to collapse onto the base frame 10 and alternatively snapping onto the base frame by outer downward edges of the seat frame 20 just passing on the outside edges of the base frame 10. Said collapsibility makes the bouncer especially flat and easy to handle and transport in a collapsed state as will be shown later.

FIG. 2A illustrates three bouncing positions of a bouncer 200 according to prior art wherein a base frame 210 is connected to a seat frame 220 in a single pivot connection 250, here in the form of a flexible frame part between said frames. The longitudinal side part 221 of the seat frame 220 is shown as visible through the contours of the seat. The three positions of the bouncer 200 are examples of an upright and a reclined position as well as an unstrained middle position.

FIG. 2B illustrates the movement of the seat frame in FIG. 2A in a simplified manner by only depicting the positions of side part 221 of the seat frame as representing the tilted state of the seat in the movement from an upright position in 221*a* through a middle position 221*b* to a reclined position 221*c*. As may be seen from the figure, the rear part of the seat moves both downward and rearwards during said movement as shown by arrow 201, whereas the front part of the seat only moves in a slight rearward pivoting movement, as shown by arrow 202. In total, the seat of this bouncer moves in the general direction of arrow 203 with a virtual centre of rotation 204 positioned slightly below the seat at its front end. The effect of this pivoting movement is that the head of the baby is exposed to a rather long and circular travel path.

FIG. 3A illustrates three bouncing positions of a bouncer 300 according to prior art wherein a base frame 310 is connected to a seat frame 320 and wherein the base frame 310 is concavely shaped in the longitudinal direction towards the floor as a rocking-chair. The longitudinal side part 321 of the seat frame 320 is also here shown as visible through the contours of the seat. The three positions of the bouncer 300 are examples of an upright and a reclined position as well as an unstrained middle position.

FIG. 3B illustrates the movement of the seat frame in FIG. 3A in a simplified manner by only depicting the positions of side part 321 of the seat frame as representing the tilted state of the seat in the movement from an upright position in 321*a* through a middle position 321*b* to a reclined position 321*c*. As may be seen from the figure, the rear part of the seat moves both downward and especially rearwards during said movement as shown by arrow 301, whereas the front part of the seat moves upwards and rearwards, as shown by arrow 302. In total, the seat of this bouncer moves in the general direction of arrow 303 with a virtual centre of rotation 304 positioned almost directly under the seat. An effect of this pivoting movement is that the head of the baby is exposed to a rolling movement like a rocking-chair rather than accelerations similar to rocking in the comforting arms of his parents.

FIG. 4A illustrates three bouncing positions of a bouncer 100 according to the present invention wherein a base frame 10 is connected to a seat frame 20 through double hinged rear and front distance members 40 and 50 respectively. The longitudinal side part 21 of the seat frame 20 is shown as visible through the contours of the seat. The three positions of the bouncer 100 are examples of an upright and a reclined position as well as an unstrained middle position.

FIG. 4B illustrates the movement of the seat frame in FIG. 4A in a simplified manner by only depicting the positions of side part 21 of the seat frame as representing the tilted state of the seat in the movement from an upright position in 21*a* through a middle position 21*b* to a reclined position 21*c*. As may be seen from the figure, the rear part of the seat moves downward and only slightly rearwards during said movement as shown by arrow 101, whereas the front part of the seat moves in a slight forward pivoting movement, as shown by arrow 102. In total, the seat of this bouncer moves in the general direction of arrow 103 with, in contrast to that of prior art, a virtual centre of rotation 104 positioned above the seat at its front end. The effect of this movement is more of a swinging movement, closer to the natural movement a baby experiences when being held by an adult and gently being swung in the adult's arms. Said movement is found to be less stressing for the baby and reduces the travel path of the baby's head compared to prior art single hinged bouncers, while at the same time reducing the travel path of the baby's legs compared to a rocking-chair bouncer.

Figure 5:
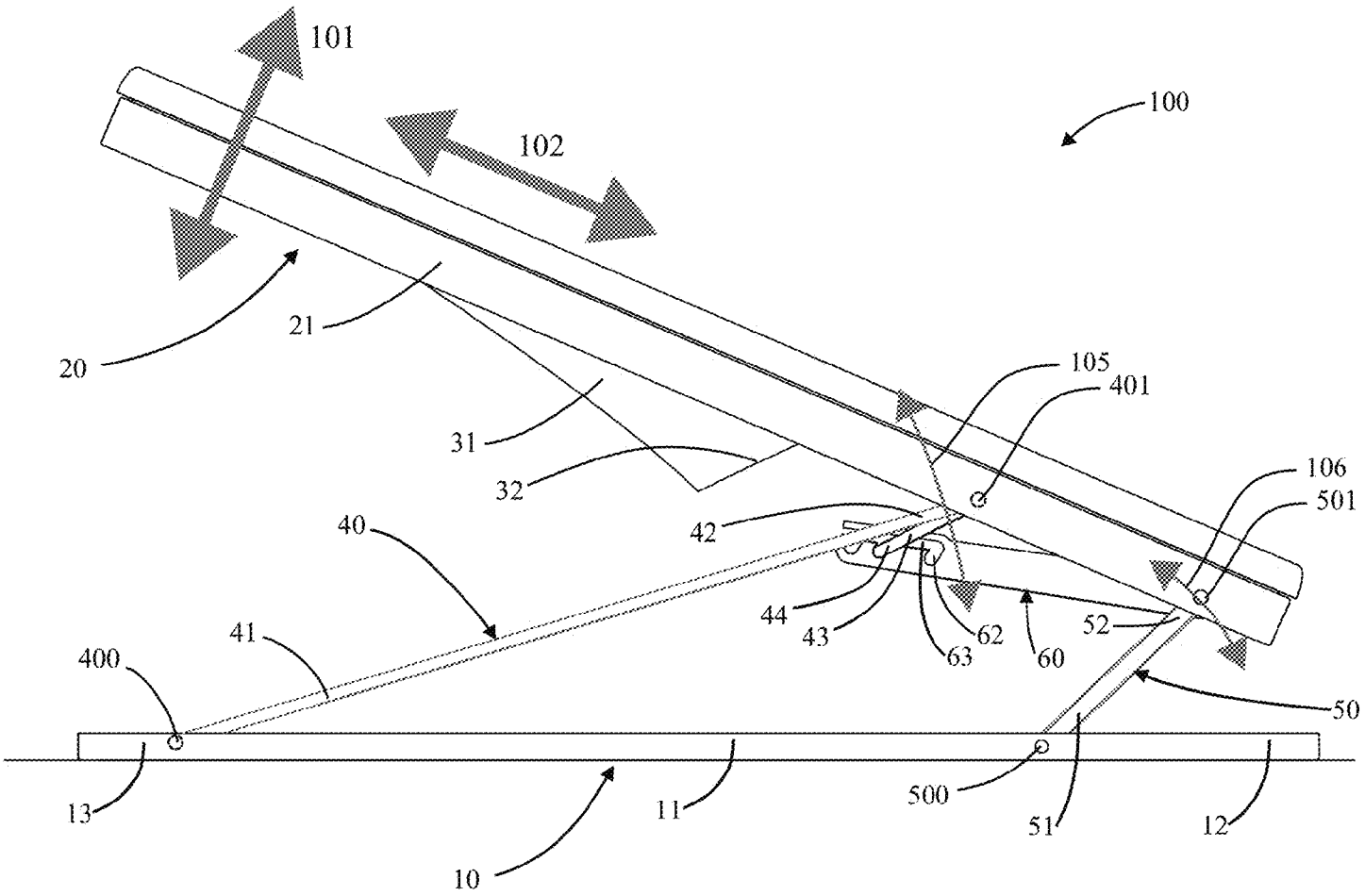
FIG. 5 shows a side view of the bouncer in FIG. 1A.

FIG. 5 shows a detailed embodiment of a bouncer 100 according to the present invention. The base frame 10 comprises rear and front base frame pivot mountings 400 and 500 wherein first ends 41 and 51 of the rear and front distance members 40 and 50 are hinged to the rear 13 and front 12 part of the base frame, respectively. The seat frame 20 further comprises rear and front seat pivot mountings 401 and 501 wherein second ends 42 and 52 of the rear and front distance members 40 and 50 are hinged to the seat frame, respectively. It should be noted that the "rear" and "front" indexing of the pivot mountings is an indication of their geometric relation to each other, and not necessarily to their actual position on said frames.

In this embodiment, both rear and front seat pivot mountings 401 and 501 in the seat frame 20 are positioned in the front part of said frame, the mounting for the front distance member 50 positioned in front of the mounting for the rear distance member 40. The result is that the rear distance member 40 is considerably longer than the front distance member 50 in order for the seat to be in a reasonable half reclined position for a baby, in this example more than three times the length. The lengths of said distance members 40, 50 affect their effective pivot radius and hence their movement when pivoted. The base frame 10 with rear and front base pivot mountings 400 and 500 is resting immobile on a support (i.e. a floor), the movement of the rear and front seat pivot mountings 401 and 501 hence follow the movement indicated by arrows 105 and 106 respectively. Since the rear distance member 40 is considerably longer than the front distance member 50 it has a larger rotational radius than the front member. In the exemplified inclined position of the seat, the rear distance member 40 is also more inclined (at about 30°) than the front distance member 50 (at about 45°). During bouncing, the movement of the rear seat pivot mountings 401 becomes mainly vertical with only a comparable smaller longitudinal movement, while the movement of the front seat pivot mountings 501 is both vertical and horizontal due to the initial angle of the front distance member 50. The resulting movement of the seat is hence as described earlier with movement components both vertically and horizontally as indicated by arrow 101 and 102.

In order for the bouncer to remain in an expanded condition without collapsing, the rotation of the rear and front distance members 40 and 50 must be locked in relation to each other, such as by one or more rotational locking means. Said means may be a locking of the rotation in one or more of the pivot mountings 400, 401, 500 and/or 501 or other means.

Alternatively, rotational locking may be provided by a spacer connected to any two of a rear distance member, a front distance member, a base frame, and a seat frame. The spacer is positioned in order to hinder rotation of said members or frames. As a minimum, at least a first part of such a spacer needs to be connect in a distance from the pivot mountings of the member or frame it is connected to, while a second part may be connected to either a different member or frame, or one of the pivot mountings other than the pivot mountings of the member or frame it is connected to, provided the seat and base frame, and the distance members are not in a parallel configuration.

In the embodiment shown in FIG. 5, a temporary and adjustable locking is achieved by a spacer 60. The spacer is hinged in its front end to the front part of the seat frame 20, in this example to the same front pivot mounting 501 as the front distance member 50. In addition, said spacer 60 is hinged to the second end of the rear distance member 40, in this example by a return member 43 of the rear distance members 40, projecting back from the rear seat pivot mounting 401. In this example the return member 43 has a slightly downward inclined angle compared to the rear distance member 40. By locking the angular movement between the rear and front distance members 40 and 50 by said spacer 60, the seat may be locked in an expanded state of the bouncer.

The spacer 60 comprises a longitudinal slot 63 with downwards-directed recesses 63 spaced apart along the length of the slot 63, which is open in the rearward direction. A transversal part of the return members 43 free end 44 may run in said slot 63 to adjust the angle between the rear and front distance members, and fit into the recess 62, thus locking said angle.

By moving the return members 43 free end 44 rearward and out of the open ended slot 63 the bouncer may be collapsed flat. In order for the seat frame 20 to be collapsible onto the base frame 10, the distance from the rear end of the seat frame 20 to the rear seat pivot mountings 401 should be about equal to the distance between the rear end of the base frame 10 and the rear base frame pivot mounting 400 plus the length of the rear distance member 40. Similarly, the distance from the front end of the seat frame 20 to the front seat pivot mountings 501 plus the length of the front distance member 50 should be about equal to the distance between the front end of the base frame 10 and the front base frame pivot mounting 500. In one alternative, the length of the rear distance member 40 is shorter than the distance between the rear and front base frame pivot mountings 400 and 500 to hinder overlap of the rear and front distance members 40 and 50 when the bouncer is collapsed.

In order for the bouncer to have a bouncing movement or feathering effect as illustrated in FIGS. 4A and 4B, the rotation of the rear and front distance members 40 and 50 in relation to each other may be spring-loaded. Such spring loading may be obtained without spacer by any of the pivot mountings 400, 401, 500 and/or 501 providing torsional spring mounting and hence limiting the angular pivot movement of one or more ends of any of the distance members 40 or 50. Alternatively, any of the distance members 40 or 50, or the return member 43 may be flexible or bendable. Alternatively the length of the spacer 60 may be flexible or any of the pivot mountings may slide within the distance members or the frames.

FIGS. 6A-6B illustrate a bouncer 100 and its bouncing or swinging movement. The bouncer comprises rear and front distance members 40 and 50, respectively, and wherein a spacer 600 is hinged in its first end to the front seat pivot mounting 501 and wherein the rear distance member 40 comprises a return member 43 connected in its end 44 in a hinged manner to the second end of said spacer 600. The spacer 600 in this embodiment comprises a front and rear threaded shaft connected by an outer coupling threaded on the inside allowing continuous adjustment of the effective length of said spacer by simply turning said coupling.

FIG. 6A illustrates the bouncer 100 in an expanded position, with the seat frame 20 in a relative upright position. The rear distance member 40 is in a relative inclined angle, about 30°, while the front distance member 50 is almost vertical. In this example, the rear distance member 40, comprising parallel metal rods, are flexible to some extent, allowing the seat frame to tilt down and forward and altering the rotational position between the rear and front distance members as seen in FIG. 6B. The total effect of this flexibility is shown in FIG. 6C wherein the FIGS. 6A and B have been superimposed. As may be noticed, the rear distance member 40 has flexed quite importantly downwards into a bent state, while the front distance member 50 has tilted forwards and downwards, giving the seat frame 20 a swinging movement. As may be seen in FIG. 6C, the angle between the rear distance member 40 and its return member 43 is smaller in the upper position than in the lower position, which illustrates that there may also be a torsional rotation between said two parts if connected. Alternatively, in the event that the rear distance member 40 is stiff and not flexible, a spring loading may be provided between the rear distance member 40 and its return member 43, such as a torsion spring effect.

Figure 7:
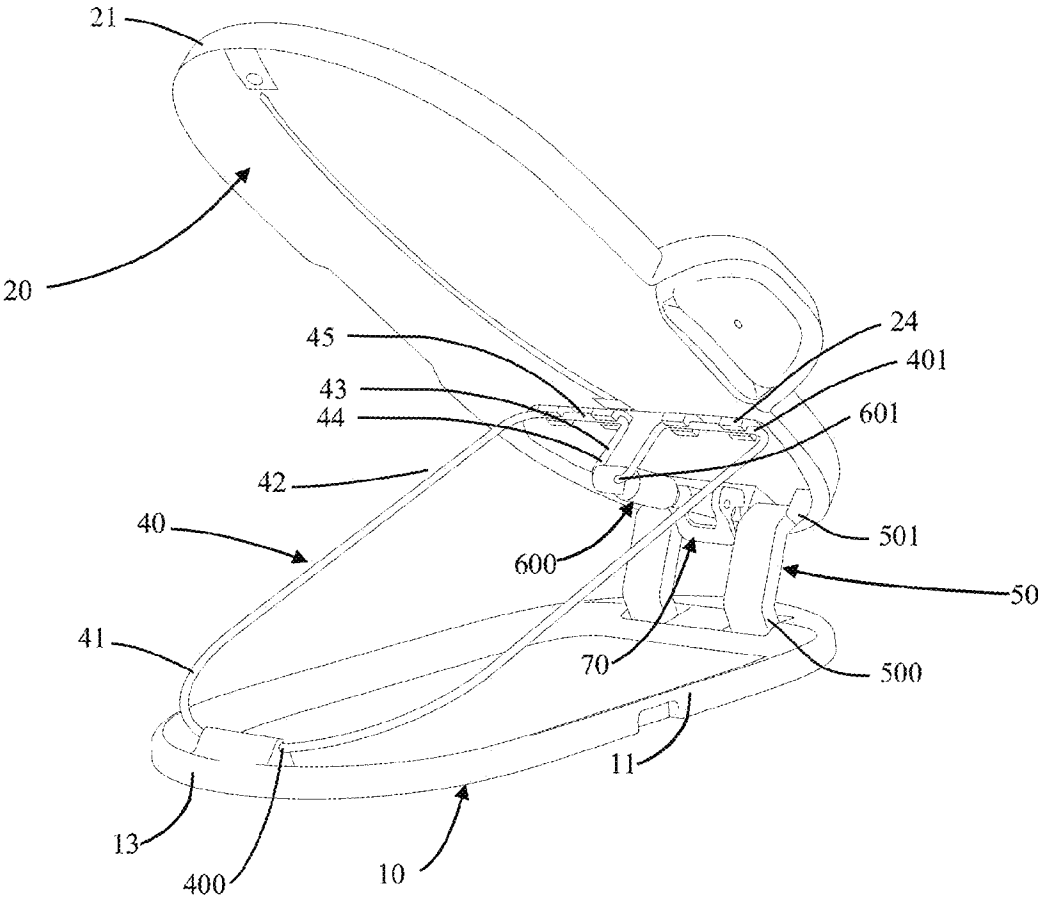
FIG. 7 shows a perspective rear view of the bouncer in FIGS. 6A-C.

FIG. 7 illustrates the bouncer in FIGS. 6A-C in a rear view wherein an example of said arrangement of the rear distance member 40 and its return member 43 is given.

In this embodiment, the rear distance members 40 are connected to or form part of a closed or partly closed frame with two parallel longitudinal rods having first and second ends 41 and 42 respectively. The first ends 41 round of laterally towards each other to be hinged in the base frame 10 rear pivot mounting 400. The second ends 42 round of inwardly to lateral crosspieces 45, hinged to the seat frame 20 in the seats rear pivot mountings 41, which in this example are clips 24 receiving said crosspieces 45. The inward ends of the lateral crosspieces 45 extend rearwards in parallel into a longitudinal return member 43, which rear ends 44 are directed inward into a mutual lateral piece which is hinged to the rear end of the spacer 600 through the spacers rear pivot mounting 601. The longitudinal return member 43 may be offset in its inclination in relation to the inclination of the rest of the rear distance member 40, said inclination relating to inclination within the symmetry plane of the bouncer 100.

Hence, in order to obtain an alternative spring loading in relation to the movement of the seat, the crosspieces 45 may have a torsion capacity, in allowing the rear piece 43 and rear distance members 40 rotate in relation to each dependent on the load on said parts from the seat.

In another alternative, the spacer 600 may be spring loaded, such as by a coil spring within said spacer, which could be telescopic, similar to a conventional shock absorber construction.

In the present embodiment, the spacer 600 comprises a telescopic function allowing the spacer to expand upon activation by the lever 700, which allows the bouncer to be collapsed.

FIGS. 8A and 8B illustrates the bouncer in two different expanded states, FIG. 8A wherein the seat is in a more up-right position in an angle A compared to FIG. 8B where the seat in a more reclined position in an angle B, both angles with respect to the base frame or support. The difference in angle positioning of the seat is regulated by the length of the spacer 600 and both figures also show the state of said spacer 600 in a detailed view.

The spacer 600 comprises a rear spacer element 610 hinged to the rear end 44 of the return member 43 in a rear spacer pivot mounting 601. The spacer 600 also comprises a front spacer element 620 hinged to the seat frame 20 in a pivot mounting 501. Said front spacer element 620 also houses a middle spacer element 630 in this embodiment for additional functionalities which will be explained later. However, said middle spacer element 630 may alternatively be an integrated part of the front spacer element 620 for seat angle regulation purposes.

The rear and front spacer elements 610 and 620 are connected by a distance regulating means 640 for shortening or lengthening of the spacer 600. In this embodiment, the distance regulating means is a sleeve 640 threaded on the inside which receives facing threaded ends of both the rear and front spacer elements 610 and 620 (either directly or indirectly), which upon turning of said sleeve retracts or separates said spacer elements 610 and 620 towards or away from each other.

In FIG. 8A the seat is in an upright position angle A, due to the total length of the spacer 600 being retracted, the rear and front spacer elements 610 and 620 being in their closest positions to each other and in this embodiment in contact with each other. The shortening of the spacer 600 raises the seat angle as the distance between the front of the seat frame 20 and the front part of the rear distance member 40 (at a distance from the front end due to the return member) is shortened, forcing the front distance member 50 upright towards the rear while the rear distance member 40 moves somewhat up and rearwards due to the set distance between the seat frames hinged mountings.

In FIG. 8B the seat is in a reclined position angle B, due to the length of the spacer 600 being extended, wherein the rear and front spacer elements 610 and 620 being farther apart from each other. The extension of the spacer 600 lowers the seat angle as the distance between the front of the seat frame 20 and the front part of the rear distance member 40 (at a distance from the front end due to the return member) is extended, forcing the front distance member 50 forward and somewhat downwards while the rear distance member 40 moves somewhat down and forward, while the distance the distance members connection to the frame remains the same.

It should be noted that a relative small change in the length of the spacer 600 changes the seat angle quite importantly. Hence, by using a relative coarse threading in the sleeve and interacting spacer pieces 610 and 630, as illustrated in the figures, a small rotational adjustment of the sleeve 640 (such as a half or one, or two full turns) may be sufficient to provide the desired angle change of the seat.

The optional middle spacer element 630 shown in this embodiment is slidingly connected to the front spacer element 620. In this embodiment the middle spacer element has a front part in the form of a cylinder which may slide within an adapted housing of the front spacer element 620. The rear end of the middle spacer element 630 is threaded on the outside to fit the sleeve 640. The front end 632 of the middle spacer element 630 comprises a locking element 633 cooperating with an outside locking organ 703. In this embodiment the locking element 633 of the middle spacer element 630 is a recess (or hole) into which the locking organ 703 may enter, in this case in the form of pin, locking the sliding ability of the middle spacer element 630 in relation to the front spacer element 620. The locking organ 703 is operated by a lever 702 which upon actuation may insert or remove said pin 703 to let the middle spacer element 630 slide freely within the front spacer element 620. It should be noted that the recess of said locking element 633 in this embodiment has a small rearward lip or protrusion on the front top edge of the recess. Similarly, said locking organ 703 entering said recess has a forward protrusion or shoe form, lodging the pin under said lip. This alternative provides the requirement of a certain force or a further insertion of the middle spacer element 630 into the front spacer element 620 before releasing the locking organ from the locking element and collapsing the bouncer. Said function may provide a "click" sensation upon locking or unlocking as a confirmation that the spacer is locked.

FIGS. 9A-9C illustrate how an expanded bouncer is collapsed and locked in a transport or storage position.

In FIG. 9A the bouncer is expanded, the seat frame 20 resting in an angled position in relation to the base frame 10, held in position by the spacer 600. The spacer 600 is in a somewhat expanded seat regulated mode, (rear spacer element 610 being separated from the middle spacer element 630) providing the shown degree of inclination of the seat. From this position, tilting of the seat may be performed by turning the sleeve, and a spring loading from either flexible rear (or front) distance members 40/50, spring torsion in the return member 43, or spring loading of the spacer 600, may provide a swinging movement of the bouncer when rocked by the baby or a caretaker.

From the detailed view it can be seen how the middle spacer element 630 is positioned all the way into the housing of the front spacer element 620. In this position, the locking element 633 is aligned with the locking organ 703, which has entered said element. The locking organ 703 may be rotated by the handle 702 through its rotational mounting 701 on the front spacer element 620 to unlock the middle spacer element 630 from the front spacer element 620 so that the middle spacer element may slide freely rearwards in order to collapse the seat. In this embodiment the above-mentioned forward protrusion of the pin is blocked by the rearward lip or protrusion on the front top edge of the locking element 633. Hence, in order to unlock the spacer 600, the middle spacer element 630, which is forced rearward by the weight of the seat and possibly a baby therein, must be forced somewhat forward into front spacer element 620 for the pins 703 front end to clear the rearward lip of the locking element 633.

In FIG. 9B, the locking organ 703, here the pin, has been extracted from the locking element 633, the hole or recess in middle spacer element 630, and the middle spacer element 630 is free to slide further rearward and out of the housing of the front spacer element 620 to let the seat be collapsed. It should be noted that the pivoting of the locking organ 703 and handle 702 may be spring loaded, forcing the locking organ towards the locking element. Hence the handle should be applied until the spacer has started to expand. Thereafter, upon releasing the handle 702, the locking organ will tilt back into the empty part of the housing of front spacer element 620.

In this embodiment, the mutual pivot mounting 501 (of both the top end of the front distance member 50 and the front end of the spacer 600), provides a stopper in the pin of said mounting for the front end of the middle spacer element 630 when inserted into the housing of the front spacer element 620.

In FIG. 9C the bouncer is collapsed, the seat frame 20 resting on the base frame 10, the two frames creating room between them to accommodate the spacer 600. From the detailed view it can be seen how the spacer 600 is still in the slight expanded seat regulated mode, (rear spacer element 610 being separated from the middle spacer element 630). However, the spacer is additionally expanded as the middle spacer element 630 has slid further rearward and partly out of the housing of the front spacer element 620. This expansion of the spacer 600 allows both the rear and front distance members 40 and 50 to be lowered forward to a practically horizontal position, stacked within the space between the seat frame 20 resting on the base frame 10. The handle 702 is in this figure still actuated against a possible spring loading in this figure. However, when releasing said handle the locking organ 703 will enter the empty part of the housing of front spacer element 620.

In this embodiment, the seat frame 20 may be detachably locked to the base frame 10 by just fitting onto the base in a precise manner, possibly by deploying one or more friction areas where the two frames are clamped together, or possibly by the use of one or more locks, such as a snap lock. Alternatively, the locking device within the spacer could be used by providing a second set of locking elements and/or locking organs to the middle and front spacer elements 630, 620 to lock the spacer in a expanded state as shown in FIG. 9C.

When expanding the bouncer again, as in FIG. 9B, the seat frame 20 is raised until the middle spacer element 630 has entered the full length of the housing of the front spacer element 620 and the locking element 633 is aligned with the locking organ 703.

The front end of the middle spacer element has a slanted front end, askew rearwards and in the same direction as the tilting of the locking organ 630. Hence, upon insertion again of the middle spacer element 630, its front end will force the locking organ 703 to tilt out of the housing of the front spacer element 620, against any spring loading. When the middle spacer element is fully inserted in the housing, the locking organ 703 will slip into the locking element 633 by its spring loading without any need for actuating the handle 702 securing that the seat frame 20 is locked in position.

From this position, tilting of the seat may be performed by turning the sleeve, and a spring loading from either flexible rear (or front) distance members 40/50, spring torsion in the return member 43, or spring loading of the spacer 600, may provide a swinging movement of the bouncer when rocked by the baby or a caretaker.

The invention claimed is:

1. A bouncer comprising:

a base frame and a seat frame, wherein the seat frame is pivotally connected to the base frame by at least one rear and at least one front distance member, and during bouncer operation an inclination of the seat frame relative to the base frame alternately increases and decreases;

a first end of each rear distance member is connected to the base frame at a rear base frame pivot mounting, and a second end of each rear distance member is connected to the seat frame at a rear seat frame pivot mounting;

a first end of each front distance member is connected to the base frame at a front base frame pivot mounting, and a second end of each front distance member is connected to the seat frame at a front seat frame pivot mounting; and wherein within a vertical longitudinal plane of the bouncer, a distance D1 between the rear base frame pivot mounting and the rear seat frame pivot mounting is larger than a distance D2 between the front base frame pivot mounting and the front seat frame pivot mounting; and the at least one rear distance member includes a biasing element configured to elastically deform in response to changes in the inclination of the seat frame.

2. The bouncer of claim 1, wherein an angle between the front and rear distance members is limited by a spacer that is pivotally connected to at least two of: the rear distance member(s), the front distance member(s), the base frame and the seat frame.

3. The bouncer of claim 2, wherein the spacer is length adjustable to permit adjustment of the inclination of the seat frame.

4. A bouncer comprising:

a base frame;

a seat frame; and a support device movably connecting the seat frame to the base frame so that when the bouncer is in a use position the seat frame is inclined relative to the base frame; wherein the support device is attached to the base frame, is attached to the seat frame at one or more respective first connection portions, and includes a biasing element that responds to changes in the inclination of the seat frame;

wherein the support device includes at least one distance member connecting at least one of said first connection portions to at least one second connection portion of the base frame;

wherein when the bouncer is in the use position each one of said at least one distance members extends from the base frame forwards;

wherein the biasing element comprises at least one return member at an end of the at least one distance member, wherein the return member elastically deforms in response to changes in the inclination of the seat frame; and wherein during bouncer operation the inclination of the seat frame relative to the base frame alternately increases and decreases, and when the relative inclination of the seat frame to the base frame decreases the one or more first connection portions move forward relative to the base frame, and when the relative inclination of the seat frame to the base frame increases the one or more first connection portions move backward relative to the base frame.

5. A bouncer comprising:

a base frame;

a seat frame; and a support device movably connecting the seat frame to the base frame so that when the bouncer is in a use position the seat frame is inclined relative to the base frame; wherein the support device is attached to the base frame, is attached to the seat frame at one or more respective first connection portions, and includes a biasing element that responds to changes in the inclination of the seat frame;

wherein the support device includes at least one distance member connecting at least one of said first connection portions to at least one second connection portion of the base frame;

wherein when the bouncer is in the use position each one of said at least one distance members extends from the base frame forwards;

wherein the biasing element comprises the at least one distance member, and the at least one distance member elastically deforms in response to changes in the inclination of the seat frame; and wherein during bouncer operation the inclination of the seat frame relative to the base frame alternately increases and decreases, and when the relative inclination of the seat frame to the base frame decreases the one or more first connection portions move forward relative to the base frame, and when the relative inclination of the seat frame to the base frame increases the one or more first connection portions move backward relative to the base frame.

6. The bouncer of claim 5, wherein when the bouncer is in the use position the seat frame is inclined relative to the base frame at an inner angle between the base frame and the seat frame of 15-35 degrees.

7. A bouncer comprising:

a base frame;

a seat frame; and a support device movably connecting the seat frame to the base frame so that when the bouncer is in a use position the seat frame is inclined relative to the base frame; wherein the support device is attached to the base frame, is attached to the seat frame at one or more respective first connection portions, and includes a biasing element that responds to changes in the inclination of the seat frame;

wherein the support device includes at least one distance member connecting at least one of said first connection portions to at least one second connection portion of the base frame;

wherein when the bouncer is in the use position each one of said at least one distance members extends from the base frame forwards;

wherein the biasing element comprises a torsion spring attached at a first end to any one of the at least one distance members and at a second end to any one of the base frame or the seat frame, so that the torsion spring is stressed in response to changes in the inclination of the seat frame; and wherein during bouncer operation the inclination of the seat frame relative to the base frame alternately increases and decreases, and when the relative inclination of the seat frame to the base frame decreases the one or more first connection portions move forward relative to the base frame, and when the relative inclination of the seat frame to the base frame increases the one or more first connection portions move backward relative to the base frame.

8. The bouncer of claim 7, wherein the second end of the torsion spring is rotatably hinged at the respective base frame or seat frame, the second end of the torsion spring is provided with a lever, and the lever is connected to the respective base frame or seat frame by a length-adjustable spacer.

9. The bouncer of claim 8, wherein the spacer comprises a first and a second axially aligned spacer element provided with inverse threads on an outside thereof, said spacer elements being joined by a matching threaded sleeve, such that a length of the spacer is adjusted by rotation of the sleeve.

10. The bouncer of claim 9, wherein the spacer comprises a quick-release mechanism comprising a guide means in which the first spacer element is axially slidable, and a locking element movable between a locking position which prevents movement of the first spacer element within the guide means, and a release position which allows the first spacer element to move freely relative to the guide means.

* * * * *